US009217942B2

(12) United States Patent
Shirai et al.

(10) Patent No.: US 9,217,942 B2
(45) Date of Patent: Dec. 22, 2015

(54) TONER FOR ELECTROSTATIC IMAGE DEVELOPMENT

(71) Applicant: Konica Minolta, Inc., Tokyo (JP)

(72) Inventors: Aya Shirai, Tokyo (JP); Hiroshi Nagasawa, Tokyo (JP); Kaori Matsushima, Tokyo (JP); Masahiro Matsuoka, Tokyo (JP); Takaki Kawamura, Tokyo (JP); Taiki Amemiya, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/283,835

(22) Filed: May 21, 2014

(65) Prior Publication Data

US 2014/0349231 A1 Nov. 27, 2014

(30) Foreign Application Priority Data

May 23, 2013 (JP) ..... 2013-108693

(51) Int. Cl.
*G03G 9/087* (2006.01)
*G03G 9/08* (2006.01)
*G03G 9/093* (2006.01)

(52) U.S. Cl.
CPC ..... *G03G 9/0825* (2013.01); *G03G 9/08702* (2013.01); *G03G 9/08711* (2013.01); *G03G 9/08755* (2013.01); *G03G 9/08795* (2013.01); *G03G 9/08797* (2013.01); *G03G 9/09321* (2013.01); *G03G 9/09328* (2013.01); *G03G 9/09392* (2013.01)

(58) Field of Classification Search
CPC ..... G03G 9/0825; G03G 9/08702; G03G 9/08711
USPC ..... 430/110.1, 109.3
See application file for complete search history.

(56) References Cited

U.S. PATENT DOCUMENTS

2007/0141500 A1* 6/2007 Sugimoto et al. ..... 430/110.3
2010/0151377 A1* 6/2010 Uchino et al. ..... 430/110.2

(Continued)

FOREIGN PATENT DOCUMENTS

JP 2001-142249 5/2001
JP 2001-222138 A 8/2001

(Continued)

OTHER PUBLICATIONS

English language machine translation of JP 2011-232738 (Nov. 2011).*

(Continued)

*Primary Examiner* — Christopher Rodee
(74) *Attorney, Agent, or Firm* — Lucas & Mercanti, LLP

(57) ABSTRACT

Disclosed is a toner for electrostatic image development that has excellent low-temperature fixability and also has sufficient heat-resistant storage stability. The toner for electrostatic image development includes toner particles containing an amorphous resin including amorphous resins A and B and a crystalline polyester resin. The toner particles have a domain-matrix structure in which a domain phase including fine core particles of the crystalline polyester resin is dispersed in a matrix phase formed of the amorphous resin A composed of a vinyl-based polymer. The surface of the fine core particles of the crystalline polyester resin is coated with the amorphous resin B composed of a vinyl-based polymer.

10 Claims, 2 Drawing Sheets

(56) References Cited

U.S. PATENT DOCUMENTS

| | | | | |
|---|---|---|---|---|
| 2011/0244383 | A1* | 10/2011 | Yamamoto et al. | 430/108.4 |
| 2012/0082926 | A1* | 4/2012 | Suzuki et al. | 430/110.1 |

FOREIGN PATENT DOCUMENTS

| | | | |
|---|---|---|---|
| JP | 2002-287405 | | 10/2002 |
| JP | 2009-204669 | | 9/2009 |
| JP | 2011-081355 | A | 4/2011 |
| JP | 2011-197659 | A | 10/2011 |
| JP | 2011-232738 | | 11/2011 |
| JP | 2012-113123 | | 6/2012 |

OTHER PUBLICATIONS

English language machine translation of JP 2001-142249 (May 2001).*

Office Action dated Apr. 21, 2015 from the corresponding Japanese patent application No. 2013-108693.

English translation of Office Action dated Apr. 21, 2015 from the corresponding Japanese patent application No. 2013-108693.

* cited by examiner

TONER FOR ELECTROSTATIC IMAGE DEVELOPMENT

CROSS REFERENCE TO RELATED APPLICATION

This Application claims the priority of Japanese Patent Application No. 2013-108693 filed on May 23, 2013, which is incorporated by reference herein.

TECHNICAL FIELD

The present invention relates to a toner for electrostatic image development that is used in image formation of an electrophotographic system.

BACKGROUND ART

Recently, to achieve higher energy saving in image forming apparatuses of an electrophotographic system, there is a need for a toner for electrostatic image development (hereinafter may be referred to simply as a "toner") that is heat-fixable at lower temperature.

For example, Patent Literature 1 discloses a toner containing a crystalline polyester resin as a fixing aid.

In such a toner, particularly good low-temperature fixability is obtained, when the compatibility between the crystalline polyester resin and a binder resin during heat fixation is high. However, one problem in this case is that heat-resistant storage stability is low because plasticization of the binder resin proceeds before heat fixation (for example, during storage of the toner). When the compatibility between the crystalline polyester resin and the binder resin is low, there arises a problem in that sufficient low-temperature fixability is not obtained.

In view of the above, Patent Literature 2, for example, proposes that the affinity between the binder resin and the crystalline polyester resin and the concentration of ester groups in the crystalline polyester resin are controlled to achieve both the low-temperature fixability and heat-resistant storage stability simultaneously.

However, in the toner described in Patent Literature 2, the binder resin is an amorphous polyester resin. Since the main skeleton of the amorphous polyester resin is similar to the main skeleton of the crystalline polyester resin, the crystalline polyester resin and the amorphous polyester resin slightly dissolve in each other during production of the toner. Due to this, there arises a problem in that sufficient heat-resistant storage stability is not obtained.

Patent Literature 3 proposes that a combination of a crystalline polyester resin and a copolymer obtained from a styrene-based monomer and a (meth)acrylate-based monomer is used as the binder resin.

However, since the types of these resins are different, the affinity between these resins is low. Therefore, there is a problem in that the crystalline polyester resin is not easily introduced into the toner particles during production of the toner, so that sufficient low-temperature fixability is not obtained.

CITATION LIST

Patent Literature

Patent Literature 1: Japanese Patent Application Laid-Open No. 2001-222138

Patent Literature 2: Japanese Patent Application Laid-Open No. 2011-81355

Patent Literature 3: Japanese Patent Application Laid-Open No. 2011-197659

SUMMARY OF INVENTION

Technical Problem

The present invention has been made on the basis of the foregoing circumstances and has as its object the provision of a toner for electrostatic image development that has good low-temperature fixability and also has sufficient heat-resistant storage stability.

Solution to Problem

To achieve at least one of the above mentioned objects, a toner for electrostatic image development reflecting one aspect of the present invention comprises toner particles containing an amorphous resin including an amorphous resin. A and an amorphous resin B, and a crystalline polyester resin, wherein the toner particles have a domain-matrix structure in which a domain phase including, fine core particles of the crystalline polyester resin is dispersed in a matrix phase including the amorphous resin A composed of a vinyl-based polymer, surface of the fine core particles being coated with the amorphous resin B composed of a vinyl-based polymer.

In the above mentioned toner for electrostatic image development, it may be preferable that the toner particles are configured such that a domain phase including a parting agent is further dispersed in the matrix phase.

In the above mentioned toner for electrostatic image development, the following relations (1) and (2) may preferably hold:

$$0.2 \leq A1 \leq 1.0 \text{ and} \qquad \text{relation (1):}$$

$$0.2 \leq A1 - B1 \leq 0.8 \qquad \text{relation (2):}$$

wherein A1 is a carboxy group concentration [mmol/g] in the amorphous resin A, and B1 is a carboxy group concentration [mmol/g] in the amorphous resin B, and an ester group concentration in the crystalline polyester resin may preferably be 7.0 to 12.0 mmol/g.

In the above mentioned toner for electrostatic image development, the carboxy group concentration B1 in the amorphous resin B may preferably be 0 to 0.35 mmol/g.

In the above mentioned toner for electrostatic image development, a melting point of the crystalline polyester resin may preferably be 40 to 95° C.

In the above mentioned toner for electrostatic image development, a weight average molecular weight of the amorphous resin B may preferably be 100,000 to 250,000.

In the above mentioned toner for electrostatic image development, the content of the crystalline polyester resin in the toner particles may preferably be 5 to 30% by mass.

In the above mentioned toner for electrostatic image development, the mass ratio of the crystalline polyester resin to the amorphous resin B (the crystalline polyester resin/the amorphous resin B may preferably be 10/90 to 80/20.

In the above mentioned toner for electrostatic image development, the toner particles may preferably be obtained by aggregating and fusion-bonding fine particles of the amorphous resin A and fine composite particles that are obtained by subjecting the vinyl-based monomer forming the amorphous resin B to seed polymerization using the fine core particles of the crystalline polyester resin as seeds, with the surface of the fine core particles being coated with the amorphous resin B.

In the above mentioned toner for electrostatic image development, the toner particles may have a core-shell structure including a core particle and a shell layer coating the surface of the core particle, and each core particle may have the domain-matrix structure.

Advantageous Effects of Invention

The above mentioned toner for electrostatic image development according to the present invention includes toner particles having a domain-matrix structure in which a domain phase including fine core particles of a crystalline polyester resin is dispersed in a matrix phase comprising an amorphous resin A, the surface of the fine core particles being coated with an amorphous resin B. Therefore, the toner has good low-temperature fixability and also has sufficient heat-resistant storage stability.

DESCRIPTION OF EMBODIMENTS

The present invention will next be described in detail.

Toner:

The toner of the present invention includes toner particles containing, as a binder resin, an amorphous resin and a crystalline polyester resin, and the toner particles may contain additional toner components such as a colorant, a magnetic powder, a parting agent and a charge control agent as needed. In addition, external additives such as a flowability improver and a cleaning aid may be added to the toner particles.

The toner of the present invention can be obtained by a wet production process, such as an emulsion aggregation process, in which the toner is produced in a water-based medium.

The toner particles according to the toner of the present invention have a domain-max structure in which a domain phase is dispersed in a matrix phase.

The domain-matrix structure is a structure in which the domain phase including closed boundaries (boundaries between the phases) is present in the continuous matrix phase.

Figure 1:
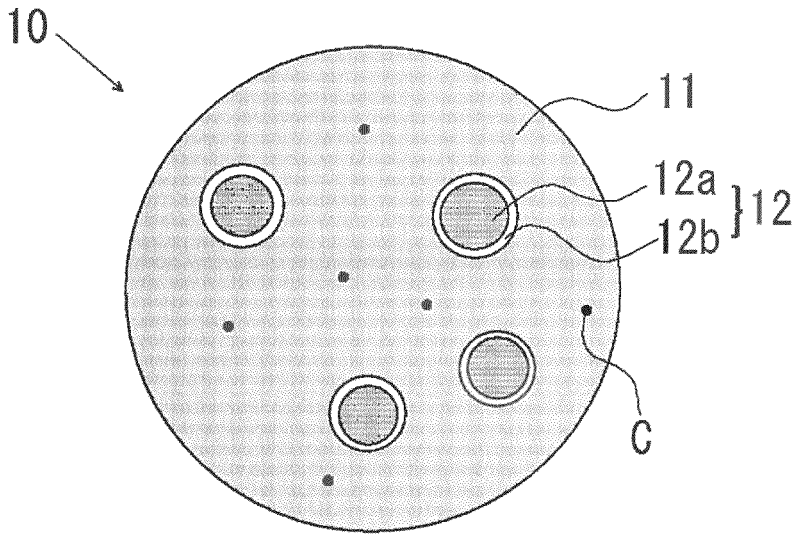
[FIG. 1] is a diagram illustrating an example of a cross section of a particle of the toner for electrostatic image development, according to the present invention.

More specifically, as shown in FIG. 1, in a toner particle 10, islands of a domain phase 12 that are composed of fine core particles 12*a* of the crystalline polyester resin with their surface coated with a coating layer 12*b* formed of an amorphous resin B are dispersed in a sea-like matrix phase 11 composed of an amorphous resin A. In FIG. 1, reference symbol C represents a toner component such as a colorant.

In the toner particle 10, the coating layer 12*b* in the domain phase 12 covers the surface of the fine core particles 12*a* and serves as a partition between the matrix phase 11 and the fine core particles 12*a*. The toner particle 10 is not limited to that shown in FIG. 1 in which the surface of the fine core particles 12*a* is fully coated with the coating layer 12*b*. For example, the surface of the fine core particles 12*a* may not be fully coated with the coating layer 12*b*, and part of the surface of the fine core particles 12*a* may be exposed.

The domain phase 12 may be present as a domain phase independent of domain phases of the colorant and the parting agent or may coexist with these domain phases. It is more preferable that the domain phase 12 is present as an independent domain phase.

The above-described structure can be observed in cross-sectioned toner particles stained with osmium under a transmission electron microscope (TEM) using a method known per se in the art. When an ultramicrotome is used to cut a slice, the thickness of the slice is set to 100 nm.

The average diameter of the domain phase 12 is preferably about 0.05 to about 2 μm.

In the present invention, the average diameter of the domain phase is a value measured on an image observed under the transmission electron microscope (TEM) described above. More specifically, in the observed TEM image, the average of the horizontal Feret diameter and vertical Feret diameter of each island of the domain phase is used as the diameter of the each island, and the average of the diameters of the islands of the domain phase is computed as the average domain phase diameter.

Binder Resin:

The binder resin at least contains two types of amorphous resins (an amorphous resin A and an amorphous resin B) composed of a vinyl-based polymer and a crystalline polyester resin.

Amorphous Resin A:

The amorphous resin A constituting the matrix phase 11 serves as the main component of the binder resin and is a vinyl-based polymer formed using a vinyl-based monomer α.

As specific examples of the amorphous resin A, may be mentioned acrylic resins and styrene-acrylic copolymer resins.

The following monomers etc. can be used as the vinyl-based monomer α. Such vinyl-based monomers α may be used either singly or in any combination thereof.

(1) Styrene-based Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, d-n-hexylstyrene, p-n-octylstyrene, p-n-nonylstyrene, p-n-decylstyrene, p-n-dodecylstyrene, derivatives thereof, etc.

(2) (Meth)Acrylate-based Monomers

Methyl(meth)acrylate, ethyl(meth)acrylate, n-butyl(meth)acrylate, isopropyl(meth)acrylate, isobutyl(meth)acrylate, t-butyl(meth)acrylate, n-octyl(meth)acrylate, 2-ethylhexyl(meth)acrylate, stearyl(meth)acrylate, lauryl(meth)acrylate, phenyl(meth)acrylate, diethylaminoethyl(meth)acrylate, dimethylaminoethyl(meth)acrylate, derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6) N-Vinyl Compounds

N-vinylcarbazole, N-vinylindole, N-vinylpyrrolidone, etc.

(7) Others

Vinyl compounds such as vinylnaphthalene and vinylpyridine, derivatives of acrylic acid and methacrylic acid such as acrylonitrile, methacrylonitrile and acrylamide, etc.

The vinyl-based monomer α used is preferably a monomer having an ionic leaving group such as a carboxy group, a sulfonate group or a phosphate group. Specific examples include the following monomers.

As examples of the monomer having a carboxy group, may be mentioned acrylic acid, methacrylic acid, maleic acid, itaconic acid, cinnamic acid, fumaric acid, maleic acid monoalkyl esters and itaconic acid monoalkyl esters. As examples of the monomer having a sulfonate group, may be mentioned styrenesulfonic acid, allyl sulfosuccinic acid and 2-acrylamide-2-methylpropane sulfonic acid. As examples of the monomer having a phosphate group, may be mentioned acidphosphoxyethyl methacrylate.

In the present invention, the monomer having a carboxy group must be used as the vinyl-based monomer α, and the ratio of the monomer having a carboxy group to all the vinyl-based monomers is preferably 2 to 7% by mass. If the ratio of the monomer having a carboxy group is excessively high, the amount of water adsorbed on the surface of the toner particles becomes large. In this case, toner blisters may occur, and the environmental difference in the amount of charge may increase.

In addition, a polyfunctional vinyl may be used as a vinyl-based monomer α to allow the vinyl-based polymer to have a cross-linked structure. As examples of the polyfunctional vinyl, may be mentioned divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate and neopentyl glycol diacrylate.

The amorphous resin. A constituting the matrix phase 11 has high compatibility with the crystalline polyester resin constituting the fine core particles 12*a* in the domain phase 12 and has low compatibility with the amorphous resin B constituting the coating layer 12*b* in the domain phase 12. Therefore, the domain-matrix structure defined in the present invention can be formed.

In the present invention, the degree of compatibility is determined using the relationship between the carboxy group concentration in an amorphous resin and the ester group concentration in the crystalline polyester resin.

The carboxy group concentration A1 in the amorphous resin A is preferably 0.2 to 1.0 mmol/g, more preferably 0.3 to 0.85 mmol/g.

When the carboxy group concentration A1 in the amorphous resin A is within the above range, the amorphous resin A is compatible with the crystalline polyester resin, in relation to the ester group concentration in the crystalline polyester resin constituting the fine core particles 12*a* in the domain phase 12. Therefore, the crystalline polyester resin efficiently facilitates plasticization of the amorphous resin A during heat fixation, and good low-temperature fixability is thereby obtained.

If the carboxy group concentration A1 in the amorphous resin A is excessively small, the compatibility between the amorphous resin A and the crystalline polyester resin becomes low. In this case, the crystalline polyester resin cannot sufficiently facilitate the plasticization of the amorphous resin A during heat fixation, so that good low-temperature fixability may not be obtained. If the carboxy group concentration A1 in the amorphous resin A is excessively high, the compatibility between the amorphous resin A and the crystalline polyester resin becomes excessively high. In this case, when the surface of the fine core particles 12*a* is not fully coated with the coating layer 12*h* formed of the amorphous resin. B, the crystalline polyester resin in the fine core particles 12*a* may exude into the amorphous resin A in the matrix phase 11 before heat fixation (for example, during storage of the toner), and the amorphous resin A may thereby be plasticized, so that sufficient heat-resistant storage stability may not be ensured.

The carboxy group concentration is the ratio of carboxy groups in the amorphous resin and represents the affinity for water. The larger the value of the carboxy group concentration is, the higher the affinity for water is.

The carboxy group concentration in the amorphous resin can be controlled by changing the introduction ratio of the monomer having a carboxy group.

In the present invention, the carboxy group concentration is a value computed using the following formula (1):

carboxy group concentration=[the number of moles of carboxy groups the sum of (the molecular weight of each vinyl-based monomer forming the amorphous vinyl polymer×its molar fraction)]×1000. Formula (1):

The glass transition point (Tg) of the amorphous resin A is preferably 25 to 60° C., more preferably 40 to 55° C.

When the glass transition point of the amorphous resin A falls within the above range, both low-temperature fixability and heat-resistant storage stability are achieved simultaneously in a reliable manner.

If the glass transition point of the amorphous resin A is excessively low, the heat resistance (thermal strength) of the toner deteriorates. In this case, sufficient heat-resistant storage stability and hot offset resistance may not be obtained. If the glass transition point of the amorphous resin A is excessively high, sufficient low-temperature fixability may not be obtained.

In the present invention, the glass transition point (Tg) of an amorphous resin is a value measured using "Diamond DSC" (manufactured by PerkinElmer Co., Ltd.).

The procedure of the measurement will next be described. First, 3.0 mg of a measurement sample (the amorphous resin) is sealed in an aluminum-made pan, and the pan is placed in a holder. An empty aluminum-made pan is used as a reference. A Heat-cool-Heat cycle is performed in the measurement temperature range of 0 to 200° C. while the temperature is controlled under the measurement conditions of a temperature increase rate of 10° C./min and a temperature decrease rate of 10° C./min. Analysis is performed using data in the 2nd heating, and the intersection of the extension of a base line before the rising edge of a first endothermic peak and a tangential line representing the maximum inclination between the rising edge of the first endothermic peak and the top of the peak is used as the glass transition point.

The weight-average molecular weight (Mw) of the amorphous resin A measured by gel permeation chromatography (CPC) is preferably 10,000 to 60,000.

When the molecular weight of the amorphous resin A falls within the above range, favorable fixability and heat-resistant storage stability are obtained.

In the present invention, the molecular weight of the amorphous resin measured by gel permeation chromatography (GPC) is a value measured as follows.

The molecular weight is measured using an apparatus "HLC-8120020" (manufactured by TOSOH Corporation) and a column "TSKguardcolumn+TSKgel SuperHZM-M (three in series)" (manufactured by TOSOH Corporation) in the flow of tetrahydrofuran (THE) used as a carrier solvent at a flow rate of 0.2 mL/min while the temperature of the column is held at 40° C. The measurement sample (the amorphous resin) is dissolved in tetrahydrofuran at a concentration of 1 mgmt using an ultrasonic disperser. In this case, the dissolving treatment is performed at room temperature for 5 minutes. Next, the obtained solution is treated through a membrane filter having a pore size of 0.2 μm to obtain a sample solution, and 10 μL of the sample solution together with the above-described carrier solvent is injected into the apparatus. Detection is performed using a refractive index detector (RI detector), and the molecular weight distribution of the measurement sample is computed using a calibration curve, determined using monodispersed polystyrene standard particles. Ten different types of polystyrene were used for the determination of the calibration on curve.

The content of the amorphous resin A in the toner particles is preferably 70 to 95% by mass.

When the content of the amorphous resin A falls within the above range, favorable fixability and heat-resistant storage stability are obtained.

Crystalline Polyester Resin:

The crystalline polyester resin constituting the fine core particles 12*a* in the domain phase 12 is any publicly known polyester resin obtained by a polycondensation reaction of a divalent or higher carboxylic acid (polyvalent carboxylic acid) and a dihydric or higher alcohol (a polyhydric alcohol) and showing a clear endothermic peak rather than a stepwise endothermic change in differential scanning calorimetry (DSC). Specifically, the clear endothermic peak is an endothermic peak with a half-value width of 15° C. or less in differential scanning calorimetry (DSC) when the measurement is performed at a temperature increase rate of 10° C./min.

The polyvalent carboxylic acid is a compound having two or more carboxy groups in its molecule.

As specific examples of the polyvalent carboxylic acid, may be mentioned: saturated aliphatic dicarboxylic acids such as succinic acid; alicyclic dicarboxylic acids such as cyclohexane dicarboxylic acid; aromatic dicarboxylic acids such as phthalic acid, isophthalic acid and terephthalic acid; trivalent or higher polyvalent carboxylic acids such as trimellitic acid and pyromellitic acid; and anhydrides and C1 to C3 alkyl esters of these carboxylic acid compounds.

These may be used either singly or in any combination thereof.

The polyhydric alcohol is a compound having two or more hydroxy groups in its molecule.

As specific examples of the polyhydric alcohol, may be mentioned: aliphatic dials such as 1,2-propanedial, 1,3-propanediol, 1,4-butanediol, 1,5-pentanediol, 1,6-hexanediol, 1,7-heptanediol, 1,8-octanediol, neopentyl glycol and 1,4-butenediol; and trihydric or higher alcohols such as glycerin, pentaerythritol, trimethylolpropane and sorbitol.

These may be used either singly or in any combination thereof.

The crystalline polyester resin constituting the fine core particles 12*a* in the domain phase 12 has high compatibility with the amorphous resin A constituting the matrix phase 11 and has low compatibility with the amorphous resin B constituting the coating layer 12*b* in the domain phase 12.

The ester group concentration in the crystalline polyester resin is preferably 7.0 to 12.0 mmol/g, more preferably 8.0 to 9.5 mmol/g.

When the ester group concentration in the crystalline polyester resin falls within the above range, the crystalline polyester resin and the amorphous resin A are compatible with each other, in relation to the carboxy group, concentration A1 in the amorphous resin A constituting the matrix phase 11. Therefore, the crystalline polyester resin efficiently facilitates plasticization of the amorphous resin A during heat fixation, and good low-temperature fixability is thereby obtained.

If the ester group concentration in the crystalline polyester resin is excessively small, the compatibility between the amorphous resin A and the crystalline polyester resin becomes low, in this case, the crystalline polyester resin cannot sufficiently facilitate the plasticization of the amorphous resin A during heat fixation, so that excellent low-temperature fixability may not be obtained. If the ester group concentration in the crystalline polyester resin is excessively high, the compatibility between the amorphous resin A and the crystalline polyester resin becomes excessively high. In this case, when the surface of the fine core particles 12*a* is not fully coated with the coating layer 12*b* formed of the amorphous resin B, the crystalline polyester resin in the fine core particles 12*a* may exude into the amorphous resin A in the matrix phase 11 before heat fixation (for example, during storage of the toner), and the amorphous resin A may be plasticized, so that sufficient heat-resistant storage stability may not be ensured.

The ester group concentration is the ratio of ester groups (ester bonds) in the crystalline polyester resin and represents the degree of affinity for water. The higher the value of the ester group concentration is, the higher the affinity for water is.

The ester group concentration in the crystalline polyester resin can be controlled, by changing the types of the monomers.

In the present invention, the ester group concentration is a value computed using the following formula (2):

ester group concentration=[the average of the numbers of moles of portions capable of forming ester groups and included in the polyvalent carboxyl acid and the polyhydric alcohol forming the crystalline polyester resin/((the sum total of the molecular weight of the polyvalent carboxyl acid and the molecular weight of the polyhydric alcohol)−(the molecular weight of water separated by dehydration polycondensation×the number of moles of ester groups))]×1000 Formula (2):

An example of the computation of the ester group concentration in the crystalline polyester resin is shown below.

A crystalline polyester resin obtained from a polyvalent carboxyl acid represented by the following formula (a) and a polyhydric alcohol represented by the following formula (b) is represented by the following formula (c).

$$HOOC—R^1—COOH \quad \text{Formula (a):}$$

$$HO—R^2—OH \quad \text{Formula (b):}$$

$$—(—OCO—R^1—COO—R^2—)_n— \quad \text{Formula (c):}$$

"The average of the numbers of moles of portions capable of forming ester groups and included, in the polyvalent carboxyl acid and the polyhydric alcohol forming the crystalline polyester resin" is the average of the number of moles of carboxy groups in the polyvalentoarboxyl acid forming the crystalline polyester resin and the number of moles of hydroxyl in the polyhydric alcohol forming the crystalline polyester resin. More specifically, this value is the average of the number of moles of carboxy groups in the polyvalent carboxyl acid of formula (a), i.e., "2," and the number of moles of hydroxy groups in the polyhydric alcohol of formula (b) i.e., "2," and is therefore "2."

Let the molecular weight of the polyvalent carboxyl acid of the formula (a) be m1, the molecular weight of the polyhydric alcohol of the formula (h) be m2, and the molecular weight of the crystalline polyester resin of the formula (c) be m3. Then "(the sum total of the molecular weight of the polyvalent carboxyl acid and the molecular weight of the polyhydric alcohol)−(the molecular weight of water separated by dehydration polycondensation×the number of moles of ester groups)" is (m1 +m2)−(18×the average number of moles of ester groups, i.e., "2") and is therefore equal to the molecular weight "m1" of the crystalline polyester resin of the formula (c).

Accordingly, the ester group concentration in the crystalline polyester resin represented by the formula (c) is "2/m3."

When two or more types of polyvalent carboxyl acids are used, the average of the numbers of moles of carboxy groups in the polyvalent carboxyl acids and the average of their molecular weights are used. When two or more types of polyhydric alcohols are used, the average of the numbers of moles of hydroxyl groups in the polyhydric alcohols and the average of their molecular weights are used.

The melting point (Tm) of the crystalline polyester resin is preferably 40 to 95° C., more preferably 50 to 85° C.

When the melting point of the crystalline polyester resin falls within the above range, sufficient low-temperature fixability and high hot offset resistance are obtained.

If the melting point of the crystalline polyester resin is excessively low, the thermal strength of the obtained toner becomes low, so that sufficient heat-resistant storage stability and hot offset resistance may not be obtained. If the melting point of the crystalline polyester resin is excessively high, sufficient low-temperature fixability may not be obtained.

The melting point of the crystalline polyester resin can be controlled by changing the composition of the resin.

In the present invention, the melting point of the crystalline polyester resin is a value measured as follows.

Specifically, the melting point is measured using a differential scanning calorimeter "Diamond DSC" (manufactured by PerkinElmer Co., Ltd.) under measurement conditions (heating-cooling conditions) including, in the following order, a first heating step of heating from 0° C. to 200° C. at a temperature increase rate of 10° C./min, a cooling step of cooling from 200° C. to 0° C. at a cooling rate of 10° C./min, and a second heating step of heating from 0° C. to 200° C. at a temperature increase rate of 10° C./min. The peak top temperature of an endothermic peak originating from the crystalline polyester in a DSC curve obtained in the first heating step in this measurement is used as the melting point. The procedure of the measurement is as follows. 3.0 mg of the measurement sample (the crystalline polyester resin) is sealed in an aluminum-made pan, and the pan is placed in a sample holder of the Diamond DSC. An empty aluminum-made pan is used as a reference.

The weight average molecular weight (Mw) of the crystalline polyester resin measured by gel permeation chromatography (GPO) is preferably 5,000 to 50,000, and its number average molecular weight (Mn) is preferably 1,500 to 25,000.

When the molecular weights of the crystalline polyester resin fall within the above ranges, the crystalline polyester resin can be favorably encapsulated in the toner particles, and favorable fixation performance is obtained.

The molecular weights of the crystalline polyester resin measured by gel permeation chromatography (GPO) are measured in the same manner as described above except that the crystalline polyester resin is used as the measurement sample.

The content of the crystalline polyester resin in the toner particles is preferably 5 to 30% by mass, more preferably 10 to 25% by mass.

When the content of the crystalline polyester resin in the toner particles falls within the above range, the crystalline polyester resin can be introduced into the toner particles in such an amount that low-temperature fixability can be achieved.

If the content of the crystalline polyester resin in the toner particles is excessively low, a sufficient amount of the crystalline polyester resin cannot be introduced, so that sufficient low-temperature fixability may not be obtained. If the content of the crystalline polyester resin in the toner particles is excessively high, the crystalline polyester resin may not be easily encapsulated in the toner particles.

Amorphous Resin B:

The amorphous resin B constituting the coating layer 12*b* in the domain phase 12 is a vinyl-based polymer formed using at least a vinyl-based monomer β.

Any of the vinyl-based monomers exemplified for the vinyl-based monomer α forming the amorphous resin. A described above may be used as the vinyl-based monomer β forming the amorphous resin B. Such vinyl-based monomers β may be used either singly or in any combination thereof. It is not necessary to use a monomer having a carboxy group as the vinyl-based monomer β.

In the toner of the present invention, it is preferable that the amorphous resin B is formed using a vinyl-based monomer having the same composition as that for the amorphous resin A constituting the matrix phase 11, i.e. the same vinyl-based monomer as that for the amorphous resin. A. When the composition of the amorphous resin A is the same as the composition of the amorphous resin B, the affinity between the amorphous resin A and the amorphous resin B can be made higher, so that the domain phase 12 can be more efficiently introduced into the matrix phase 11 during production of the toner.

The amorphous resin B constituting the coating layer 12*b* in the domain phase 12 has low compatibility with the crystalline polyester resin constituting the fine core particles 12*a* and also has low compatibility with the amorphous resin A constituting the matrix phase 11.

The carboxy group concentration B1 in the amorphous resin B is preferably 0 to 0.35 mmol/g, more preferably 0.15 to 0.25 mmol/g.

When the carboxy group concentration B1 in the amorphous resin B falls within the above range, the amorphous resin B is not compatible with the amorphous resin A and the crystalline polyester resin. Therefore, the amorphous resin B serves as a partition between the amorphous resin A in the matrix phase 11 and the crystalline polyester resin in the fine core particles 12*a* that are compatible with each other. Accordingly, the amorphous resin A and the crystalline polyester resin are prevented from being dissolved in each other before heat fixation (for example, during storage of the toner), so that heat-resistant storage stability can be ensured.

Preferably, the carboxy group concentration A1 in the amorphous resin A and the carboxy group concentration B1 in the amorphous resin B satisfy the following relation (2). More specifically, the difference between the carboxy group concentration A1 in the amorphous resin A and the carboxy group concentration B1 in the amorphous resin B, (A1−B1), is preferably not lower than 0.2 [mmol/g] and not more than 0.8 [mmol/g]

$$0.2 \leq A1 - B1 \leq 0.8 \qquad \text{Relation (2):}$$

When the difference between the carboxy group concentration A1 in the amorphous resin A and the carboxy group concentration B1 in the amorphous resin B, (A1−B1), falls within the above range, the amorphous resin B is immiscible with the amorphous resin A. Therefore, the amorphous resin. B serves as a partition between the amorphous resin A in the matrix phase 11 and the crystalline polyester resin in the fine core particles 12*a* that are compatible with each other. Accordingly, the amorphous resin A and the crystalline polyester resin are prevented from being dissolved in each other before heat fixation (for example, during storage of the toner), so that heat-resistant storage stability can be ensured.

If the difference (A1−B1) is excessively small, the compatibility between the amorphous resin A and the amorphous resin B becomes high, so that the domain-matrix structure defined in the present invention may not be formed. In addition, the crystalline polyester resin in the fine core particles 12*a* may exude into the amorphous resin A in the matrix phase 11 before heat fixation for example, during storage of the toner), and, the amorphous resin A may be plasticized, so that sufficient heat-resistant storage stability may not be ensured. If the difference (A1−B1) is excessively high, the compatibility between the amorphous resin A and the amorphous resin B becomes excessively low. In this case, when the crystalline polyester resin is introduced into the toner particles, the domain phase shown in FIG. 1 may not be formed in the toner particles, and the crystalline polyester resin may be present on the surface of the toner particles, so that heat-resistant storage stability may not be ensured.

In the domain phase 12, the mass ratio of the crystalline polyester resin to the amorphous resin B (crystalline polyester resin/amorphous resin B) is preferably 10/90 to 80/20, more preferably 15/85 to 50/50.

When the mass ratio (crystalline polyester resin/amorphous resin B) falls within die above range, the amorphous resin. A and the crystalline polyester resin are prevented from being dissolved in each other, so that favorable low-temperature fixability and neat-resistant storage stability can be obtained.

If the mass ratio (crystalline polyester resin/amorphous resin B) is excessively low, i.e., the ratio of the crystalline polyester resin is excessively low, the crystalline polyester resin may not sufficiently facilitate plasticization of the amorphous resin A, so that sufficient low-temperature fixability may not be obtained. If the mass ratio (crystalline polyester resin/amorphous resin B) is excessively high, i.e., the ratio of the crystalline polyester resin is excessively high, the coating layer 12*b* formed of the amorphous resin B may not fully surround the fine core particles 12*a* formed of the crystalline polyester resin, so that heat-resistant storage stability may not be ensured.

The glass transition point (Tg) of the amorphous resin B is preferably 25 to 60° C., more preferably 40 to 55° C.

When the glass transition point of the amorphous resin B falls within the above range, favorable low-temperature fixability can be obtained without preventing the amorphous resin A and the crystalline polyester resin from fusing during heat fixation.

The molecular weight, i.e., the weight average molecular weight (Mw), of the amorphous resin B measured by gel permeation chromatography (GPC) is preferably 10,000 to 40,000.

When the molecular weight of the amorphous resin B falls within the above range, favorable low-temperature fixability can be obtained without preventing the amorphous resin A and the crystalline polyester resin from fusing during heat fixation.

In the toner of the present invention, the binder resin may contain an additional resin other than the amorphous resin A constituting the matrix phase 11 and the crystalline polyester resin and the amorphous resin B that constitute the domain phase 12.

In the present invention, to examine the carboxy group concentrations in the amorphous resins and the ester group concentration and melting point of the crystalline polyester resin, the resins contained in the toner particles must be extracted. More specifically, the resins can be extracted from the toner particles as follows.

First, the toner is dissolved in methyl ethyl ketone (MEK) at room temperature (not lower than 20° C. and not higher than 25° C.). In this case, the amorphous resins in the toner particles dissolve in MEK at room temperature. Therefore, the components dissolved an MEK include the amorphous resins, and the dissolved amorphous resins are obtained from a supernatant separated by centrifugation. The solids after centrifugation are heated at 65° C. for 60 minutes and dissolved in tetrahydrofuran (THF). The resultant solution is filtrated through a glass filter at 60° C., and the crystalline polyester resin is obtained from the filtrate. Note that if the temperature decreases during filtration in the above procedure, the crystalline polyester resin precipitates, and therefore, the procedure should be performed while the temperature is maintained.

The carboxy group concentrations in the amorphous resins can be determined by, for example, 12C-NMR (nuclear magnetic resonance) measurement using, deuteriochloroform. More specifically, peaks of carbon atoms originating from the respective monomers are identified, and the types of monomers and the compositional ratio are specified to compute the carboxy group concentrations.

The ester group concentration in the crystalline polyester resin can be determined by hydrolyzing the crystalline polyester resin, performing measurement by P-GC/MS, and specifying the types of acid and alcohol monomers to compute the ester group concentration.

Figure 2:
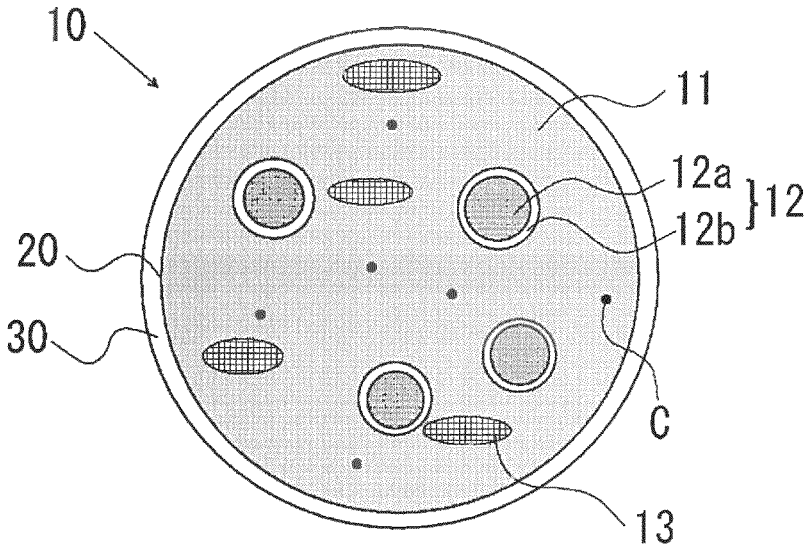
[FIG. 2] is a diagram illustrating another example of the particle of the toner for electrostatic image development according to the present invention.

Preferably, in the toner of the present invention, the toner particles have a core-shell structure in which the surface of core particles is coated with a shell layer. More specifically, is preferable that, in each toner particle 10, the surface of the core particle 20 having the domain-matrix structure is coated with the shell layer 30, as shown in FIG. 2.

The shell layer is not limited to that fully covering the core particle, but part of the surface of the core particle may be exposed.

When the toner particles have the core-shell structure, more reliable neat-resistant: storage stability can be obtained.

No particular limitation is imposed on the resin constituting the shell layer, and an amorphous polyester resin, an amorphous vinyl-based resin, etc. are preferred.

The thickness of the shell layer is preferably 0.1 to 1 μm.

In the present invention, the thickness of the shell layer is a value measured from an image observed under a transmission electron microscope (TEM).

The content of the resin constituting the shell layer in the toner particles is preferably 5 to 30% by mass.

Colorant:

In the toner of the present invention, when the toner particles are configured to contain a colorant, the colorant may be contained in any of the matrix phase 11 and the domain phase 12. When the toner particles have the core-shell structure, the colorant may be contained in any of the core particles and the shell layer.

Any of various colorants such as carbon black, black iron oxide, dyes and pigments can be used as the colorant.

As examples of the carbon black, may be mentioned channel black, furnace black, acetylene black, thermal black and lamp black. As examples of the black iron oxide, may be mentioned magnetite, hematite and iron titanium trioxide.

As examples of the dye, may be mentioned C.I. Solvent Red: 1, 49, 52, 58, 63, 111 and 122, C.I. Solvent Yellow: 19, 44, 77, 79, 81, 82, 93, 98, 103, 104, 112 and 162 and C.I. Solvent Blue: 25, 36, 60, 70, 93 and 95.

As examples of the pigment, may be mentioned C.I. Pigment Red: 5, 48:1, 48:3, 53:1, 57:1, 81:4, 122, 139, 144, 149, 150, 166, 177, 178, 222, 238 and 269, C.I. Pigment Orange: 31 and 43, C.I. Pigment Yellow: 14, 17, 74, 93, 94, 138, 155, 156, 158, 180 and 185, C.I. Pigment Green: 7 and C.I. Pigment Blue: 15:3 and 60.

One colorant, or a combination of two or more colorants may be used for a color toner.

The content of the colorant in the toner particles is preferably 1 to 10% by mass, more preferably 2 to 8% by mass, if the content of the colorant is excessively small, the toner obtained may not have the desired coloring power. If the content of the colorant is excessively large, the colorant may be separated or adhere to a carrier etc., and this may affect charge property.

Parting Agent:

In the toner of the present invention, when the toner particles are configured to contain a parting agent, the parting agent may be contained in any of the matrix phase 11 and the domain phase 12. When the toner particles have, the core-shell structure, the parting agent may be contained in any of the core particles and the shell layer. Preferably, the parting agent is contained in each core particle 20 as a second domain phase 13 that is present in the matrix phase 11 formed of the amorphous resin A and independent of the domain phase 12, as shown in FIG. 2. Inc average diameter of the second domain phase 13 formed of the parting agent is preferably 0.05 to 2 μm.

When the parting agent is present as the second domain phase independent of the domain phase 12 formed of the resin, i.e., is immiscible with the domain phase 12, exudation of the parting agent from the surface layer of the toner is not inhibited when the parting agent is heated and melted during heat fixation, so that favorable fixation separability can be achieved.

Any of various publicly known waxes may be used as the parting agent.

Any of polyolefin-based waxes such as low-molecular weight polypropylene wax, low-molecular weight polyethylene wax, oxidized-type polypropylene wax and oxidized-type polyethylene wax and ester-based waxes such as behenic acid behenate wax can be particularly preferably used.

As specific examples of the wax, may be mentioned: polyolefin waxes such as polyethylene wax and polypropylene wax; branched chain hydrocarbon waxes such as microcrystalline wax; long chain, hydrocarbon-based waxes such as paraffin wax and Sasol wax; dialkyl ketone-based waxes such as distearyl ketone; ester-based waxes such as carnauba wax, montan wax, behenic acid behenate, trimethylolpropane tribehenate pentaerythritol tetrabehenate, pentaerythritol diacetate dibehenate, glycerin tribehenate 1,18-octadecanediol distearate, tristearyl trimellitate and distearyl maleate; and amide-based waxes such as ethylenediamine behenylamide and tristearyl trimellitate amide.

Of these, a wax having a low melting point, i.e., a melting point of 40 to 90° C., is preferably used from the viewpoint of releasability during low temperature fixation.

The content of the parting agent in the toner particles is preferably 1 to 20% by mass, more preferably 5 to 20% by mass. When the content of the parting agent in the toner particles falls within the above range, releasability and fixability can be achieved simultaneously in a reliable manner.

Charge Control Agent:

In the toner of the present invention, when the toner particles are configured to contain a charge control agent, the charge control agent may be contained in any of the matrix phase 11 and the domain phase 12. When the toner particles have the core-shell structure, the charge control agent may be contained in any of the core particles and the shell layer.

Any of various publicly known compounds may be used as the charge control agent.

The content of the charge control agent in the toner particles is preferably 0.1 to 10% by mass, more preferably 1 to 5% by mass.

External Additives:

The toner particles in the toner of the present invention can be used as the toner without adding any additive. However, to improve flowability, charge property, cleanability, etc., external additives such as a flowability improver and a cleaning aid may be added to the toner particles.

A combination of various external additives may be used.

The ratio of the total amount of the external additives added is preferably 0.05 to 5 parts by mass, more preferably 0.1 to 3 parts by mass per 100 parts by mass of the toner particles.

Glass Transition Point of Toner:

The toner of the present invention has a glass transition point (Tg) of preferably 25 to 50° C., more preferably 25 to 45° C.

When the glass transition point of the toner of the present invention falls within the above range, sufficient low-temperature fixability and heat-resistant storage stability are obtained simultaneously in a reliable manner. If the glass transition point of the tanner is excessively low, the heat resistance (thermal strength) of the toner deteriorates. In this case, sufficient heat-resistant storage stability and hot offset resistance may not be obtained. If the glass transition point of the on is excessively high, sufficient low-temperature fixability may not be obtained.

The glass transition point of the toner is measured in the same manner as described above except that the toner is used as the measurement sample.

Particle Diameter of Toner:

The average particle diameter, for example, the volume-based median diameter, of the toner of the present invention is preferably 3 to 8 μm, more preferably 5 to 8 μm. The average particle diameter can be controlled by changing the concentration of an aggregating agent used for production of the toner, the amount added of an organic solvent, fusion-bonding time, the chemical composition of the binder resin, etc.

When the volume-based median diameter falls within the above range, a very fine dot image of 1200 dpi can be faithfully reproduced.

The volume-based median diameter of the toner is measured and computed using a measuring device composed of "Multisizer 3" (manufactured by Beckman Coulter, Inc.) and a computer system connected thereto and equipped with data processing software "Software V3.51." More specifically, 0.02 q of a measurement sample (the toner) is added to 20 mL of a surfactant solution (a surfactant solution used for the purpose of dispersion the toner particles and prepared, for example, by diluting a neutral detergent containing a surfactant component ten-fold with pure water) and is left to stand. The obtained solution is subjected to ultrasonic dispersion for 1 minute to prepare a dispersion of the toner. This toner dispersion is added with a pipette to a beaker containing "ISOTON II" (manufactured by Beckman Coulter, Inc.) and held in a sample stand until the concentration displayed in the measuring device reaches 8%. By using the above concentration range, a reproducible measurement value can be obtained. In the measuring device, the number of particles to be counted is set to 25,000, and the diameter of an aperture is set to 100 μm. Toe range of measurement, a 2 to 60 μm range, is divided into 256 sections, and a frequency value in each section is computed. The particle size when a cumulative volume fraction cumulated from the large-diameter side reaches 50% is used as the volume-based median diameter.

Average Circularity of Toner:

In the toner of the present invention, the average circularity of the toner particles included in the toner is preferably 0.930 to 1.000, more preferably 0.950 to 0.995 from the viewpoint of stability of electrification characteristics ant low-temperature fixability.

When the average circularity falls within the above range, individual toner particles are less likely to be broken. Therefore, contamination of a triboelectrifying member is suppressed, so that the charge property of the toner are stabilized. In addition, the quality of a formed image becomes high.

The average circularity of the toner is a value measured using "FPIA-2100" (manufactured by Sysmex Corporation). More specifically, a measurement sample (the toner) is left to stand in a surfactant-containing aqueous solution and then subjected to ultrasonic dispersion treatment for 1 minute to disperse the toner. Then images of the toner are taken using the "FPTA-2100" (manufactured by Sysmex Corporation) in an HPF (high-power field) measurement mode at an appropriate concentration in which the number of particles detected in the HPF mode is 3,000 to 10,000. The circularity of each of the particles is computed using the following formula (y). The computed circularity values of the toner particles are summed up, and the sum total is divided by the total number of toner particles to compute the average circularity. When the number of particles detected in the HPF mode falls within the above range, reproducibility is obtained.

circularity=(the circumferential length of a circle having the same area as the projected area of a particle image)/(the circumferential length of the projected particle image) Formula (y):

Developer:

The toner of the present invention can be used as a magnetic or non-magnetic one-component developer or may be mixed with a carrier and used as a two-component developer. When the toner is used as a two-component developer, the carrier used may be magnetic particles of a publicly known material such as a metal, for example, iron, ferrite or magnetite or an alloy of any of these metals with a metal such as aluminum or lead. Ferrite particles are particularly preferred. The carrier used may be a coated carrier prepared by coating the surface of magnetic particles with a coating agent such as a resin or a dispersion-type carrier prepared by dispersing a fine magnetic powder in a hinder resin.

The volume-based median diameter of the carrier is preferably 20 to 100 μm, more preferably 25 to 80 μm. A representative example of the device used to measure the volume-based median diameter of the carrier is a laser diffraction-type particle size distribution measuring device "HELOS" (manufactured by SYMPATEC) equipped with a wet-type disperser.

In the toner described above, the toner particles 10 has the domain-matrix structure in which the domain phase 12 is dispersed in the matrix phase 11 composed of the amorphous resin A. In the domain phase 12, the surface of the fine core particles 12*a* formed of the crystalline polyester resin is coated with the coating layer 12*b* formed of the amorphous resin B. More specifically, the surface layer region of the domain phase 12 is formed of the amorphous resin B immiscible with the amorphous resin A and the crystalline polyester resin. Therefore, the amorphous resin B serves as a partition to prevent the amorphous resin A and the crystalline polyester resin compatible with each other from being dissolved in each other. In this case, sufficient heat-resistant storage stability can be ensured before heat fixation. During heat fixation, the coating layer 12*b* formed of the amorphous resin B is broker, and the crystalline polyester resin exudes into the amorphous resin A. Then the crystalline polyester resin and the amorphous resin A dissolve in each other. Therefore, the plasticizing effect of the crystalline polyester resin can be achieved sufficiently, and excellent low-temperature fixability can thereby be achieved.

Production Process of Toner:

As examples of the production process of the toner, may be mentioned a wet production process, such as an emulsion aggregation process, in which the toner is produced in a water-based medium.

In the production process of the toner of the present invention using the emulsion aggregation process, a water-based dispersion containing fine particles of the binder resin (hereinafter may be referenced to as "fine binder resin particles") dispersed in a water-based medium is mixed with a water-based dispersion containing fine particles of the colorant (hereinafter may be referred to as "fine colorant particles"). Then the fine binder resin particles and the fine colorant particles are aggregated and heat-fused to form toner particles, whereby the toner is produced.

The fine binder resin particles may have a multilayer structure including two or more layers composed of binder resins with different compositions. The fine binder resin particles having such a structure, for example, a two-layer structure, can be obtained by the following process. A dispersion of resin particles is prepared by polymerization treatment (first polymerization) known per se in the art. Then, a polymerization initiator and a polymerizable monomer are added to the dispersion, and the resultant system is subjected to polymerization treatment (second polymerization).

A seed polymerization process, for example, may be used as the process of producing the toner particles having the domain-matrix structure according to the present invention. More specifically, the fine core particles formed of the crystalline polyester resin are used as seeds, and the vinyl-based monomer β is seed-polymerized on the surface of the fine core particles, whereby fine composite particles with the surface of the fine core particles coated with the amorphous resin B are obtained. These fine composite particles and fine particles of the amorphous resin A, together with fine, colorant particles etc. as needed, are aggregated and fused, whereby toner particles having the domain-matrix structure can be produced.

A "water-based dispersion" is a dispersion containing a dispersoid (particles) dispersed in a water-based medium, and the water-based medium is a medium composed mainly of water (50% by mass or more). A component other than water may be an organic solvent soluble in water. As examples of such an organic solvent, may be mentioned methanol, ethanol, isopropanol, butanol, acetone, methyl ethyl ketone and tetrahydrofuran.

Of these, alcohol-based organic solvents such as methanol, ethanol, isopropanol and butanol that are organic solvents not dissolving the resin are particularly preferred.

One example of the production process of the toner of the present invention will be described specifically.

The production process includes:

(a) a step of preparing a water-based dispersion containing fine particles of the amorphous resin (hereinafter may be referred to as a "matrix resin") dispersed in a water-based medium (hereinafter the fine particles may be referred to as "fine matrix resin particles");

(b) a step of adding the vinyl-based monomer to a water-based dispersion containing fine core particles formed of the crystalline polyester resin and dispersed in a water-based medium and then performing seed polymerization of the vinyl-based monomer β using the fine core particles as seeds to thereby prepare a water-based dispersion containing dispersed therein fine composite particles composed of the fine core particles with their surface coated with the amorphous resin B (hereinafter may be referred to as a "coating resin");

(c) a step of preparing a water-based dispersion containing fine colorant particles dispersed in a water-based medium;

(d) a step of aggregating and fusion-bonding the fine matrix resin particles, the fine composite particles and the fine colorant particles on a water-based medium to form associated particles;

(e) a step of aging the associated particles using thermal energy to control their shape, whereby toner particles are obtained;

(f) a step of cooling the dispersion of the toner particles;

(g) a step of separating the toner particles from the water-based medium by filtration), no remove a surfactant etc. from the toner particles;

(h) a step of drying the washed toner particles; and (i) an optional step of adding external additives to the dried toner particles.

(a) Step of Preparing Water-based Dispersion of Fine Matrix Resin Particles

In this step, the water-based dispersion of the fine matrix resin particles composed of the amorphous resin A forming the matrix phase is prepared.

The water-based dispersion of the fine matrix resin particles can be prepared by a miniemuision polymerization process using the vinyl-based monomer α for obtaining the amorphous resin A. More specifically, for example, the vinyl-based monomer α is added to a water-based medium containing a surfactant, and mechanical energy is applied to form liquid droplets. Then a polymerization reaction is allowed to proceed in the liquid droplets via radicals from a water-soluble radical polymerization initiator. The liquid droplets may contain an oil-soluble polymerization initiator. The water-based dispersion of the fine matrix resin particles composed of the amorphous resin A can thereby be prepared.

Surfactant:

The surfactant used in this step may be any of various publicly known surfactants such as anionic surfactants, cationic surfactants and nonionic surfactants.

Polymerization Initiator:

The polymerization initiator used in this step may be any of various publicly known polymerization initiators. As specific preferred examples of the polymerization initiator, may be mentioned persulfates (for example, potassium persulfate and ammonium persulfate). In addition, any of azo-based compounds (for example, 4,4'-azobis-4-cyanovaleric acid and salts thereof and 2,2'-azobis(2-amidinopropane) salts), peroxide compounds and azobisisobutyrenitrile may be used.

Chain Transfer Agent:

In this step, any generally used chain transfer agent may be used for the purpose of controlling the molecular weight of the matrix resin. No particular limitation is imposed on the chain transfer agent, and as examples thereof, may be mentioned 2-chloroethanol, mercaptans such as octyl mercaptan, dodecyl mercaptan and t-dodecyl mercaptan and a styrene dimer.

If necessary, the toner particles according to the present invention may contain, in addition to the binder resin, other internal additives such as a parting agent and a charge control agent. Such internal, additives may be introduced into the toner particles by, for example, dissolving or dispersing the internal additives in the solution of the vinyl-based monomer α for forming the matrix resin in advance in this step.

Such internal additives may also be introduced into the toner particles as follows. A dispersion of internal additive particles composed only of the internal additives is prepared separately. Then the internal additive particles are aggregated together with the fine matrix resin particles, the fine composite particles and the fine colorant particles in the aggregating and fusion-bonding step. However, it is preferable to use the method in which the internal, additives are introduced in advance in this step.

The average particle diameter, i.e., the volume-based median diameter, of the fine matrix resin particles is preferably within the range of 20 to 400 nm.

In the present invention, the volume-based median diameter of the fine matrix resin particles is a value measured using "Microtrac UPA-150" (manufactured by NIKKISO Co. Ltd.).

(b) Step of Preparing Water-based Dispersion of Fine Composite Particles

In this step, the water-based dispersion of the fine composite particles is prepared. The fine composite particles are composed of the fine core particles formed of the crystalline polyester resin with their surface coated with the amorphous resin B formed using the vinyl-based monomer β.

More specifically, the crystalline polyester resin is synthesized. Then the synthesized crystal line polyester resin in a fine particle form is dispersed in a water-based medium to obtain a water-based dispersion containing the fine core particles of the crystalline polyester resin dispersed therein. The vinyl-based monomer β and a polymerization initiator are added to this water-based dispersion, and seed polymerization of the vinyl-based monomer β is performed using the fine core particles of the crystalline polyester resin as seeds, whereby the water-based dispersion of the fine composite particles can be prepared.

The water-based dispersion of the fine core particles may be prepared as follows. The crystalline polyester resin is dissolved or dispersed in an organic solvent to prepare an oil phase solution, and the oil phase solution is dispersed in a water-based medium by, for example, phase inversion emulsification to form oil droplets with their particle diameter controlled to the desired value. Then the organic solvent is removed.

The amount of the water-based medium used is preferably 50 to 2,000 parts by mass, more preferably 100 to 1,000 parts by mass per 100 parts by mass of the oil phase solution.

For the purpose of improving the dispersion stability of the oil droplets, a surfactant etc. may be added to the water-based medium. As examples of the surfactant, may be mentioned those exemplified in the above step.

The organic solvent used to prepare the oil phase solution is preferably a low-boiling point solvent with low solubility in water, from the viewpoint of ease of removal after formation of the oil droplets. As specific examples of such a solvent, may be mentioned methyl acetate, ethyl acetate, methyl ethyl ketone, methyl isobutyl ketone, toluene and xylene. These solvents may be used either singly or in any combination thereof. The amount used of the organic solvent is generally 1 to 300 parts by mass per 100 parts by mass of the crystalline polyester resin.

Emulsification and dispersion of the oil phase solution may be performed by utilizing mechanical energy.

The average particle diameter, i.e., the volume-based median diameter, of the fine core particles used as seeds is preferably within the range of 10 to 280 nm.

In the present invention, the volume-based median diameter of the fine core particles is a value measured using "Microtrac UPA-150" (manufactured by NIKKISO Co., Ltd.).

In the seed polymerization, any commonly used chain transfer agent may be used, for the purpose of controlling the molecular weight of the amorphous resin B. The chain transfer agent used may be any of the above-exemplified chain transfer agents.

The polymerization initiator used may be any of the above-exemplified polymerization initiators.

Preferably, the seed polymerization is performed in a state in which the viscosity of the crystalline polyester resin is high. The polymerization temperature during seed polymerization is preferably not higher than the melting point of the crystalline polyester resin+20° C., more preferably not higher than the melting point+10° C., still more preferably not higher than the melting point.

Preferably, the average particle diameter, i.e., the volume-based median diameter, of the fine composite particles falls within the range of 20 to 400 nm.

In the present invention, the volume-based median diameter of the fine composite particles is a value measured using "Microtrac CPA-150" (manufactured by NIKKISO Co., Ltd.).

(c) Step of Preparing Water-based Dispersion of Fine Colorant Particles

This step is an optional step performed as needed when toner particles containing a colorant are desired. In this step, the colorant in a fine particle form is dispersed in a water-based medium to prepare a water-based dispersion of the fine colorant particles.

The water-based dispersion of the fine colorant particles is obtained by dispersing the colorant in a water-based medium containing a surfactant at a critical micelle concentration (CMC) or higher.

The colorant may be dispersed by utilizing mechanical energy, and no particular limitation is imposed on the disperser used. As preferred examples of the disperser, may be mentioned an ultrasonic disperser, a mechanical homogenizer pressurizing dispersers such as a Manton-Gaulin homogenizer and a pressure-type homogenizer and medium-type dispersers such as a sand grinder, a Getzmann mill and a diamond fine mill.

The dispersed fine colorant particles have a volume-based median diameter of preferably 10 to 300 nm, more preferably 100 to 200 nm, particularly preferably 100 to 150 nm.

In the present invention, the volume-based median diameter of the fine colorant particles is a value measured using an electrophoretic light-scattering photometer "ELS-800" (manufactured by Otsuka Electronics Co., Ltd.).

(d) Aggregating and Fusion-bonding Step

In this step, the fine matrix resin particles, the fine composite particles, the fine colorant particles, and if necessary, fine particles of other toner components are aggregated and fusion-bonded by heat.

More specifically, an aggregating agent is added at a concentration equal to or higher than a critical aggregation concentration to a water-based dispersion containing the above-described fine particles-dispersed in a water-based medium and the mixture is heated to a temperature higher than the glass transition points of the amorphous resins A and B to aggregate and fusion-bond the fine particles.

Preferably, in this step, after the aggregating agent is added to a water-based medium containing the fine matrix resin particles and the fine colorant particles dispersed therein at a temperature lower than the glass transition points of the amorphous resins A and B, the fine composite particles are added without increasing the temperature. Particularly preferably, the fine composite particles are added when the diameter of aggregated particles obtained by aggregation of the fine matrix resin particles and the fine colorant particles becomes ¼ to ½ the diameter of the toner particles to be formed, and then the mixture is heated to a temperature equal to or higher than the glass transition points of the amorphous resins A and B.

By adding the fine composite particles at such timing to subject them to aggregation, the fine composite particles can be encapsulated in the formed toner particles.

The fusion-bonding temperature for fusion-bonding the fine matrix resin particles and the fine composite particles may be not lower than the glass transition points of the amorphous resins A and B. Particularly, the fusion-bonding temperature is (the glass transition points of the amorphous resins A and B+10° C.) to (the glass transition points of the amorphous resins A and B+50° C.), particularly preferably (the glass transition points of the amorphous resins A and B+15° C.) to (the glass transition points of the amorphous resins A and B+40° C.).

Aggregating Agent:

No particular limitation is imposed on the aggregating agent used in this step. An aggregating agent selected from metal salts such as salts of alkali metals and salts of alkaline-earth metals is preferably used. As examples of the metal salts, may be mentioned: salts of monovalent metals such as sodium, potassium and lithium; salts of divalent metals such as calcium, magnesium, manganese and copper; and salts of trivalent metals such as iron and aluminum. As specific examples of the metal salts, may be mentioned sodium chloride, potassium chloride, lithium chloride, calcium chloride, magnesium chloride, zinc chloride, copper sulfate, magnesium sulfate and manganese sulfate. Of these, salts of divalent metals are particularly preferably used because only a small amount of such a salt allows aggregation to proceed. These may be used either singly or in any combination thereof.

When the toner particles have the core-shell structure, the fine matrix resin particles, the fine composite particles and the fine colorant particles are aggregated and fusion-bonded to form core particles in this step. Then fine shell resin particles for forming the shell layer are aggregated on and fusion-bonded to the core particles to thereby form the core-shell structure.

(e) Aging Step

This step is performed as needed. In the aging step, aging treatment is performed to age the toner particles obtained in the aggregating-fusion bonding step through thermal energy until the desired shape is obtained, whereby toner particles are formed.

More specifically, the aging treatment is performed by heating and stirring the system containing the associated particles dispersed therein. In the aging treatment, the heating temperature, stirring rate, heating time, etc. are controlled so that the associated particles have the desired circularity.

(f) Cooling Step

In this step, the dispersion of the toner particles is subjected to cooling treatment. Preferably, the cooling treatment is performed under the condition of a cooling rate of 1 to 20° C./min. No particular limitation is imposed on the specific method for cooling treatment. As examples of the method, may be mentioned a cooling method in which a coolant is introduced from the outside of a reaction container and a cooling method in which cold water is directly introduced into the reaction system.

(g) Filtration and Washing Step

In this step, the cooled dispersion of the toner particles is subjected to solid-liquid separation to separate the toner particles, and a toner cake obtained by solid-liquid separation (cake-like wet aggregates of the associated toner particles) is washed to remove adhering materials such as the surfactant and the aggregating agent.

No particular limitation is imposed on the solid-liquid separation method, and any of a centrifugation method, a vacuum filtration method using, for example, a suction funnel and a filtration method using, for example, a filter press may be used. Preferably, washing is performed with water until the electric conductivity of the filtrate becomes 10 μS/cm.

(h) Drying Step

In this step, the toner cake subjected to washing treatment is dried. This step may be performed according to a general drying step used in a publicly known production process of toner particles.

As specific examples of the dryer used to dry the toner cake, may be mentioned a spray dryer, a vacuum freeze dryer and a vacuum dryer. Preferably, any of a stationary shelf dryer, a movable shelf dryer, a fluidized-bed dryer, a rotary dryer and a stirring dryer is used.

The content of water in the dried toner particles is preferably 5% by mass or lower, more preferably 2% by mass or lower. When the dried toner particles are aggregated together through weak interparticle attractive force, the aggregates may be subjected to pulverization treatment. The pulverizer used may be a mechanical pulverizer such as a jet mill, a Henschel mixer, a coffee mill or a food processor (i) Step of Adding External Additives This step is an optional step performed as needed when external additives are added to the toner particles.

The above toner particles can be used as a toner without adding any additive. However, the toner particles may be used with external additives such as a flowability improver and a cleaning aid added thereto, in order to improve flowability, charge property, cleanability, etc.

A combination of various external additives may be used.

The total amount of the external additives added is preferably 0.05 to 5 parts by mass, more preferably 0.1 to 3 parts by mass per 100 parts by mass of the toner particles.

The mixer used for the external additives may be a mechanical mixer such as a Henschel mixer or a coffee mill.

The embodiment of the present invention has been specifically described. However, the embodiment of the present invention is not limited to the example described above, and various modifications can be made thereto.

EXAMPLES

Specific Examples of tine present invention will next be described, but the present invention is not limited thereto.

The volume-based median diameters of the fine matrix resin particles, the fine colorant particles, the fine core particles and the fine composite particles were measured in the manner described above, and the molecular weights, of the matrix resin, the crystalline polyester resin and the coating resin were measured in the manner described above.

The glass transition points (Tg) of the matrix resin, the coating resin and the toner and the melting point of the crystalline polyester resin were measured in the manners described above.

The carboxy group concentration or ester group concentration of each resin was computed in the manner described above.

Preparation Example 1 of Water-Based Dispersion of Fine Matrix Resin Particles First Polymerization:

A 5 L reaction container equipped with a stirrer, a temperature sensor, a condenser tube and a nitrogen introduction device was charged with a solution prepared by dissolving 8 g of sodium dodecyl sulfate in 3 L of ion exchanged water, and the temperature inside the container was increased to 80° C. while the mixture was stirred at a stirring rate of 230 rpm under nitrogen flow. Then a solution prepared by dissolving 10 g of potassium persulfate in 200 g of ion exchanged water was added, and the temperature of the mixture was again increased to 80° C. A vinyl-based monomer solution containing 480 g of styrene, 250 g of n-butyl acrylate and 68 g of methacrylic acid was added dropwise over one hour. The resultant mixture was heated and stirred at 80° C. for 2 hours to polymerize the monomers, whereby fine resin particles [a1] were obtained.

Second Polymerization:

A 5 L reaction container equipped with a stirrer, a temperature sensor, a condenser tube and a nitrogen introduction device was charged with a solution prepared by dissolving 7 g of polyoxyethylene (2) dodecyl ether sulfate in 800 mL of ion exchanged water, and the solution was heated to 98° C. Then 260 g of the above fine resin particles [a1] and a solution mixture obtained by dissolving and mixing at 90° C. 1.5 g of n-octyl-3-mercaptopropionate, 190 g of a parting agent (behenic acid behenate (melting point: 73° C.)) and a vinyl-based monomer solution containing 284 g of styrene, 92 g of n-butyl acrylate and 13 g of methacrylic acid were added to the heated solution. These components were mixed and dispersed for 1 hour using a mechanical disperser having a circulation path "CLEARMIX" (manufactured by M Technique Co., Ltd.) to prepare a dispersion containing emulsified particles (oil droplets).

Then an initiator solution prepared by dissolving 6 g of potassium persulfate in 200 ml ion exchanged water was added to the obtained dispersion. The resultant system was heated and stirred at 84° C. for 1 hour to perform polymerization, and fine resin particles [a2] were thereby obtained.

Third Polymerization:

A solution prepared by dissolving 11 g of potassium persulfate in 400 mL of ion exchanged water was added to the above fine resin particles [a2], and a solution mixture of 8 g of n-octyl-3-mercaptopropionate and a vinyl-based monomer solution containing 400 g of styrene, 128 q of n-butyl acrylate, 28 g of methacrylic acid and 45 g of methyl methacrylate was added dropwise over 1 hour under a temperature condition of 82° C. After completion of dropwise addition, the mixture was heated and stirred for 2 hours to perform polymerization and then cooled to 28° C. to thereby prepare a water-based dispersion [A1] of fine matrix resin particles [A1]

The fine matrix resin particles [A1] had a volume-based median diameter of 220 nm, a weight average molecular weight (Mw) of 55,000 and a glass transition point (Tg) of 52° C.

Preparation Examples 2 to 6 of Water-Based Dispersion of Fine Matrix Resin Particles Water-based dispersions [A2] to [A6] of fine matrix resin particles [A2] to [A6] were prepared in the same manner as in Preparation Example 1 of the water-based dispersion of fine matrix resin particles except that the parts by mass in the resin composition in the third polymerization, were changed as shown in TABLE 1.

For the fine matrix resin particles [A6], the resin composition in the second polymerization was also changed as shown in TABLE 1.

TABLE 1

| MATRIX RESIN | | RESIN COMPOSITION (PARTS BY MASS) STYRENE (MOLECULAR WEIGHT: 104.15) | n-BUTYL ACRYLATE (MOLECULAR WEIGHT: 126.17) | METHA-CRYLIC ACID (MOLECULAR WEIGHT: 86.09) | METHYL METHA-CRYLATE (MOLECULAR WEIGHT: 100.10) | CARBOXY GROUP CONCEN-TRATION A1 (mmol/g) | Tg (° C.) | Mw |
|---|---|---|---|---|---|---|---|---|
| FINE MATRIX RESIN PARTICLES(A1) | | 400.0 | 128.0 | 28.0 | 45.0 | 0.51 | 52 | 55000 |
| FINE MATRIX RESIN PARTICLES(A2) | | 373.1 | 117.3 | 67.0 | 42.6 | 0.95 | 58 | 57000 |
| FINE MATRIX RESIN PARTICLES(A3) | | 417.2 | 131.1 | 4.0 | 47.7 | 0.24 | 49 | 58000 |
| FINE MATRIX RESIN PARTICLES(A4) | | 406.0 | 127.6 | 20.0 | 46.4 | 0.42 | 53 | 54000 |
| FINE MATRIX RESIN PARTICLES(A5) | | 357.7 | 112.4 | 89.0 | 40.9 | 1.20 | 62 | 52000 |
| FINE MATRIX RESIN PARTICLES(A6) | THIRD POLYMERIZATION | 419.3 | 131.8 | 1.0 | 47.9 | 0.15 | 46 | 57000 |
| | SECOND POLYMERIZATION | 272.8 | 86.2 | 8.0 | 0.0 | | | |

Synthesis Example 1 of Crystalline Polyester Resin

A 5 L reaction container equipped with a stirrer, a temperature sensor, a condenser tube and a nitrogen introduction device was charged with 220 parts by mass of a polyvalent carboxyl acid, i.e., adipic acid (molecular weight: 146.14), and 174 parts by mass of a polyhydric alcohol, i.e. 1,6-hexanediol (molecular weight: 118.17). While the system was stirred, the temperature inside the container was increased to 190° C. over 1 hour. After it was confirmed that the system was uniformly stirred, $Ti(OBu)_4$ used as a catalyst was added in an amount of 0.003% by mass with respect to the amount charged of the polyvalent carboxyl acid. Then, while water generated was evaporated, the internal temperature was increased from 190° C. to 240° C. over 6 hours, and a dehydration condensation reaction was performed continuously under a temperature condition of 240° C. for 6 hours to perform polymerization, whereby a crystalline polyester resin [C1] was obtained.

The melting point (Tm) of the obtained crystalline polyester resin [C1] was 83° C., and its number average molecular weight (Mn) was 3,600, Synthesis Examples 2 to 5 of Crystalline Polyester Resin Crystalline polyester resins [C2] to [C5] were synthesized in the same manner as in Synthesis Example 1 of the crystalline polyester resin except that the types of the monomers were changed as shown in TABLE 2.

TABLE 2

| CRYSTALLINE POLYESTER RESIN | RESIN COMPOSITION POLYVALENT CARBOXYLIC ACID TYPE | MOLECULAR WEIGHT | POLYHYDRIC ALCOHOL TYPE | MOLECULAR WEIGHT | ESTER GROUP CONCENTRATION (mmol/g) | Tm (° C.) | Mn |
|---|---|---|---|---|---|---|---|
| CRYSTALLINE POLYESTER RESIN(C1) | ADIPIC ACID | 146.14 | 1,6-HEXANEDIOL | 118.17 | 8.76 | 83 | 3600 |
| CRYSTALLINE POLYESTER RESIN(C2) | ADIPIC ACID | 146.14 | ETHYLENE GLYCOL | 62.07 | 11.81 | 65 | 4100 |
| CRYSTALLINE POLYESTER RESIN(C3) | SEBACIC ACID | 202.25 | 1,6-HEXANEDIOL | 118.17 | 7.03 | 66.8 | 4500 |
| CRYSTALLINE POLYESTER RESIN(C4) | SUCCINIC ACID | 118.09 | ETHYLENE GLYCOL | 62.07 | 13.87 | 90.0 | 2100 |
| CRYSTALLINE POLYESTER RESIN(C5) | DODECANEDIOIC ACID | 230.3 | 1,12-DODECANEDIOL | 202.33 | 5.04 | 84.9 | 5500 |

Preparation Example 1 of Water-Based Dispersion of Fine Core Particles

Parts by mass of the crystalline polyester resin [C1] was melted, and the molten crystalline polyester resin [C1] was transferred to an emulsification disperser "CAVITRON CD1010" (manufactured by EUROTEC Co., Ltd.) at a transfer rate of 100 parts by mass per minute. At the same time as the transfer of the molten crystalline polyester resin [C1], diluted ammonia water: having a concentration of 0.37% by mass and prepared by diluting 70 parts by mass of an ammonia water reagent with ion exchanged water in a water-based solvent tank was transferred to the emulsification disperser at a transfer rate of 0.1 L per minute while the diluted ammonia water was heated at 100° C. in a heat exchanger. The emulsification disperser was operated under the conditions of a rotor rotation speed of 60 Hz and a pressure of 5 kg/cm$^2$ to prepare a water-based dispersion [C1] of fine core particles [C1] having a volume-based median diameter of 200 nm. The solid content in the water-based dispersion [C1] was 30 parts by mass.

Preparation Examples 2 to 5 of Water-Based Dispersion of Fine Core Particles Water-based dispersions [C2] to [C5] of fine core particles [C2] to [C5] were prepared in the same manner as in Preparation Example 1 of the water-based dispersion of the fine core particles except that one of the crystalline polyester resins [C2] to [C5] was used instead of the crystalline polyester resin [C1].

Preparation Example 1 of Water-Based Dispersion of Fine Composite Particles

A 5 L reaction container equipped with a stirrer, a temperature sensor, a condenser tube and a nitrogen introduction device was charged with 2,000 parts by mass of the water-based dispersion [C1] of the fine core particles [C1] and 1,150 parts by mass of ion exchanged water. Then a polymerization initiator solution prepared by dissolving 10.3 parts by mass of potassium persulfate in 210 parts by mass of ion exchanged water was added. Then a monomer solution mixture of 3.0 parts by mass of n-octyl mercaptan (n-OM) and a vinyl-based monomer solution used to form a coating resin and containing 412.7 parts by mass of styrene (St) 129.7 parts by mass of n-butyl acrylate (BA), 10.5 parts by mess of methacrylic acid (MAA) and 47.2 parts by mass of methyl methacrylate (MMA) was added dropwise over 2 hours under a temperature condition of 80° C., and the mixture was heated and stirred at 80° C. for 2 hours to perform seed polymerization. After completion of polymerization, the mixture was cooled to 28° C. whereby a water-based dispersion [S1] of fine composite particles [S1] was prepared.

In the water-based dispersion [S1], the volume-based median diameter of the fine composite particles [S1] was 155 nm.

Preparation Examples 2 to 11 of Water-Based Dispersion of Fine Composite Particles Water-based dispersions [S2] to [S11] of fine composite particles [S2] to [S11] were prepared in the same manner as in Preparation Example 1 of the water-based dispersion of the fine composite particles except that the parts by mass in the composition of the coating resin were changed as shown in TABLE 3 and that the type of the seeds used (fine core particles of the crystalline polyester resin) was changed as shown in TABLE 3.

TABLE 3

| | COATING RESIN | | | | | | | | SEEDS | | |
|---|---|---|---|---|---|---|---|---|---|---|---|
| | | RESIN COMPOSITION (PARTS BY MASS) | | | | | | CARBOXY GROUP CONCEN-TRATION B1 | FINE CORE PARTICLE NO. (CRYSTAL-LINE POLY-ESTER RESIN NO.) | ESTER GROUP CONCEN-TRATION | CRYSTAL-LINE POLY-ESTER RESIN/ COATING RESIN (MASS RATIO) |
| | No. | St | BA | MAA | MMA | n-OM | Mw | (mmol/g) | | (mmol/g) | |
| FINE COMPOSITE PARTICLES(S1) | B1 | 412.7 | 129.7 | 10.5 | 47.2 | 3.0 | 100000 | 0.20 | C1 | 8.76 | 50/50 |
| FINE COMPOSITE PARTICLES(S2) | B2 | 401.8 | 126.3 | 26.0 | 45.9 | 3.0 | 100000 | 0.50 | C1 | 8.76 | 50/50 |
| FINE COMPOSITE PARTICLES(S3) | B3 | 419.3 | 131.8 | 1.0 | 47.9 | 3.0 | 100000 | 0.03 | C1 | 8.76 | 50/50 |
| FINE COMPOSITE PARTICLES(S4) | B1 | 412.7 | 129.7 | 10.5 | 47.2 | 3.0 | 100000 | 0.20 | C2 | 11.61 | 50/50 |
| FINE COMPOSITE PARTICLES(S5) | B1 | 412.7 | 129.7 | 10.5 | 47.2 | 3.0 | 100000 | 0.20 | C3 | 7.03 | 50/50 |
| FINE COMPOSITE PARTICLES(S6) | B4 | 412.7 | 129.7 | 10.5 | 47.2 | 0.5 | 350000 | 0.20 | C1 | 8.76 | 50/50 |
| FINE COMPOSITE PARTICLES(S7) | B5 | 412.7 | 129.7 | 10.5 | 47.2 | 8.2 | 30000 | 0.20 | C1 | 8.76 | 50/50 |
| FINE COMPOSITE PARTICLES(S8) | B6 | 41.27 | 12.97 | 1.05 | 4.72 | 0.5 | 100000 | 0.20 | C1 | 8.76 | 5/95 |
| FINE COMPOSITE PARTICLES(S9) | B7 | 701.59 | 220.49 | 17.85 | 80.24 | 4.9 | 100000 | 0.20 | C1 | 8.76 | 85/15 |

TABLE 3-continued

| | COATING RESIN | | | | | | | | SEEDS | | |
|---|---|---|---|---|---|---|---|---|---|---|---|
| | | RESIN COMPOSITION (PARTS BY MASS) | | | | | | CARBOXY GROUP CONCEN-TRATION B1 | FINE CORE PARTICLE NO. (CRYSTAL-LINE POLY-ESTER RESIN NO.) | ESTER GROUP CONCEN-TRATION | CRYSTAL-LINE POLY-ESTER RESIN/ COATING RESIN (MASS RATIO) |
| | No. | St | BA | MAA | MMA | n-OM | Mw | (mmol/g) | | (mmol/g) | |
| FINE COMPOSITE PARTICLES (S10) | B1 | 412.7 | 129.7 | 10.5 | 47.2 | 3.0 | 100000 | 0.20 | C4 | 13.87 | 50/50 |
| FINE COMPOSITE PARTICLES (S11) | B1 | 412.7 | 129.7 | 10.5 | 47.2 | 3.0 | 100000 | 0.20 | C5 | 5.04 | 50/50 |

Preparation Example 1 of Water-Based Dispersion of Fine Colorant Particles

90 Parts by mass of sodium polyoxyethylene-2-dodecyl ether sulfate was dissolved in 1,510 parts by mass of ion exchanged water under stirring. 400 Parts by mass of carbon black "REGAL 300" (manufactured by Cabot Corporation) was gradually added to the obtained solution under stirring, and then dispersion treatment was performed using a stirrer "CLEARMIX" (manufactured by M Technique Co., Ltd.) to thereby prepare a water-based dispersion [Bk] of the fine colorant particles.

The volume-based median diameter of the fine colorant particles in the water-based dispersion [Bk] of the tine colorant particles was measured and found to be 110 nm.

Production Example 1 of toner

A separable flask equipped with a stirrer, a temperature sensor, a condenser tube and a nitrogen introduction device was charged with 2,500 parts by mass of ion exchanged water, 600 parts by mass (in terms of solids) of the water-based dispersion [A1] of the fine matrix resin particles [A1], 300 parts by mass (in terms of solids) of the water-based dispersion [S1] of the fine composite particles [S1] and 500 parts by mass of the water-based dispersion [Bk] of the fine colorant particles [Bk]. After the temperature of the solution was adjusted to 25° C., an aqueous solution of sodium hydroxide with a concentration of 25% by mass was added to adjust the pH to 10.

Next, an aqueous solution prepared by dissolving 3 parts by mass of magnesium chloride hexahydrate in 54.3 parts by mass of ion exchanged water was added, and the temperature of the system was increased to 97° C. to initiate the aggregation reaction of the resin particles and the fine colorant particles.

After the start of the aggregation reaction sampling was performed at regular intervals to measure the volume-based median diameter of the particles using a particle size distribution measuring device "Coulter Multisizer 3" (manufactured by Beckman Coulter, Inc.). Aggregation was continued under stirring until the volume-based median diameter became 6.3 μm.

Then an aqueous solution prepared by dissolving 23.0 parts by mass of sodium chloride in 92 parts by mass of ion exchanged water was added. The temperature of the system was adjusted to 95° C., and stirring was continued for 4 hours. When the circularity measured using a flow-type particle image analyzer "FPIA-2100" (manufactured by Sysmex) reached 0.946, the system was cooled to 30° C. under the condition of 6° C./min to terminate the reaction, whereby a dispersion of toner particles was obtained. The diameter of the cooled toner particles was 6.1 μm, and their circularity was 0.946.

The thus-obtained dispersion the toner particles was subjected to solid-liquid separation using a basket-type centrifuge "MARK III TYPE 60×40" (manufactured by Matsumoto Machine Manufacturing Co., Ltd.) to form a wet cake. The wet cake was repeatedly washed and subjected to solid-liquid separation in the basket-type centrifuge until the electric conductivity of the filtrate reached 15 μS/cm. Then air at a temperature of 40° C. and a humidity of 20% RH was blown using a "flash jet dryer" (manufactured by Seishin Enterprise Co., Ltd.) to dry the cake until the water content became 0.5% by mass, and the cake was cooled to 24° C. to thereby obtain toner particles [1].

1% By mass of hydrophobic silica particles and 1.2% by mass of hydrophobic titanium oxide particles were added to the obtained toner particles [1], and these particles were mixed using a Henschel mixer for 20 minutes under the condition of a peripheral speed of a rotary blade of 24 ms and were caused to pass through a 400 mesh sieve to thereby add the external additives, whereby a toner [1] was obtained. Although the hydrophobic silica particles and the hydrophobic titanium oxide particles were added to the toner [1], the shape and diameter of the toner particles were not changed.

The glass transition point of the obtained toner [1] was measured and found to be 35° C. Toner particles stained with osmium were cut using an ultramicrotome with the cutting thickness set no 100 nm. The cross sections of the toner particles were observed under a transmission electron microscope, and a domain-matrix structure was observed. The average diameter of the domain phase composed of the fine composite particles (the fine core particles formed of the crystalline polyester resin with their surface coated with an amorphous resin) was 0.8 μm, and the average diameter of the domain phase composed of the parting agent was 1.0 μm.

Production Examples 2 to 19 of Toner

Toners [2] to [19] Were obtained in the same mariner as in Production Example 1 of the toner except that the type of the water-based dispersion [A1] of the fine matrix resin particles [A1] and the type of the water-based dispersion. [S1] of the fine composite particles [S1] were changed as shown in TABLE 4.

Toners [10] and [11] were prepared by changing the amount added of the water-based dispersion of the fine composite particles such that the content of the crystalline polyester resin in the toner particles was as shown in TABLE 4.

Production Example 20 of Toner

The same procedure as in Production Example 1 of the toner was repeated until the step of aggregation performed until the volume-based median diameter reached 6.3 μm under continuous stirring.

TABLE 4

| TONER NO. | WATER-BASED DIS-PERSION NO. OF FINE MATRIX RESIN PARTICLES | WATER-BASED DISPERSION OF FINE COMPOSITE PARTICLES No. | COATING RESIN NO. | FINE CORE PART-ICLE NO. (CRYSTAL-LINE POLY-ESTER RESIN NO.) | CARBOXY GROUP CONCEN-TRATION (A1-B1) (mmol/g) | DOMAIN-MATRIX STRUCTURE | CORE-SHELL STRUCTURE | CONTENT OF CRYSTAL-LINE POLY-ESTER RESIN IN TONER PART-ICLES (% BY MASS) | CRYSTAL-LINE POLY-ESTER RESIN/ COATING RESIN (MASS RATIO) | Tg (° C.) |
|---|---|---|---|---|---|---|---|---|---|---|
| TONER(1) | A1 | S1 | B1 | C1 | 0.31 | YES | NO | 15 | 50/50 | 35 |
| TONER(2) | A2 | S2 | B2 | C1 | 0.45 | YES | NO | 15 | 50/50 | 37 |
| TONER(3) | A3 | S3 | B3 | C1 | 0.21 | YES | NO | 15 | 50/50 | 42 |
| TONER(4) | A2 | S1 | B1 | C1 | 0.75 | YES | NO | 15 | 50/50 | 35 |
| TONER(5) | A4 | S1 | B1 | C1 | 0.22 | YES | NO | 15 | 50/50 | 37 |
| TONER(6) | A1 | S4 | B1 | C2 | 0.31 | YES | NO | 15 | 50/50 | 33 |
| TONER(7) | A1 | S5 | B1 | C3 | 0.31 | YES | NO | 15 | 50/50 | 39 |
| TONER(8) | A1 | S6 | B4 | C1 | 0.31 | YES | NO | 15 | 50/50 | 38 |
| TONER(9) | A1 | S7 | B5 | C1 | 0.31 | YES | NO | 15 | 50/50 | 36 |
| TONER(10) | A1 | S1 | B1 | C1 | 0.31 | YES | NO | 35 | 50/50 | 33 |
| TONER(11) | A1 | S1 | B1 | C1 | 0.31 | YES | NO | 3 | 50/50 | 37 |
| TONER(12) | A1 | S8 | B6 | C1 | 0.31 | YES | NO | 15 | 5/95 | 38 |
| TONER(13) | A1 | S9 | B7 | C1 | 0.31 | YES | NO | 15 | 85/15 | 32 |
| TONER(14) | A5 | S2 | B2 | C1 | 0.70 | NO | NO | 15 | 50/50 | 28 |
| TONER(15) | A6 | S3 | B3 | C1 | 0.12 | YES | NO | 15 | 50/50 | 43 |
| TONER(16) | A5 | S1 | B1 | C1 | 1.00 | YES | NO | 15 | 50/50 | 33 |
| TONER(17) | A1 | S2 | B2 | C1 | 0.01 | NO | NO | 15 | 50/50 | 43 |
| TONER(18) | A1 | S10 | B1 | C4 | 0.31 | NO | NO | 15 | 50/50 | 31 |
| TONER(19) | A1 | S11 | B1 | C5 | 0.31 | YES | NO | 15 | 50/50 | 45 |
| TONER(20) | A1 | S1 | B1 | C1 | 0.31 | YES | YES | 13.5 | 50/50 | 37 |

Then 300 parts by mass of a water-based dispersion of fine shell-forming resin, particles described, in the following. Production Example was added, and the mixture was continuously stirred at 80° C. for 1 hour to allow the fine shell-forming resin particles to be fusion-bonded to the surface of the core particles, whereby a shell layer was formed.

Then the step of adding an aqueous solution prepared by adding 23.0 parts by mass of sodium chloride to 92 parts by mass of ion exchanged water and the subsequent steps in the procedure in the Production Example 1 of the toner were repeated to obtain a toner [20].

Preparation of Water-based Dispersion of Fine Shell-forming Resin Particles:

A reaction container equipped with a stirrer, a temperature sensor, a condenser tube and a nitrogen introduction device was charged with a surfactant solution prepared by dissolving 2.0 g of sodium polyoxyethylene dodecyl ether sulfate in 3,000 g of ion exchanged water, and the temperature inside the container was increased to 80° C. while the mixture was stirred at a stirring rate of 230 rpm under nitrogen flow.

An initiator solution prepared by dissolving 10 g of potassium persulfate in 200 g of ion exchanged water was added to the above solution, and a solution mixture of 12 g of n-octyl mercaptan and a vinyl-based monomer solution containing 564 g of styrene, 140 g of n-butyl acrylate and 96 g of methacrylic acid was added dropwise over 3 hours. After completion of dropwise addition, the system was heated and stirred at 80° C. for 1 hour to perform polymerization, whereby a water-based dispersion of the fine shell-forming resin particles was prepared.

Production Examples 1 to 20 of Developer

Developers [1] to [20] were produced by adding a ferrite carrier having a volume-based median diameter of 60 μm and coated with a silicone resin to each of the toners 11 to [20] such that the concentration of the toner was 6% by mass and then mixing them using a V-type mixer.

Examples 1 to 17 and Comparative Examples 1 to 3

(1) Evaluation of Low-Temperature Fixability

A fixation experiment was performed using, as an image forming apparatus, a commercial copier "bizhub PRO C6500" (manufactured by Konica Minolta Business Technologies, Inc. including a fixing unit of the thermal roller fixation type that was modified such that the surface temperature of fixation heating rollers could be changed in the range of 120 to 200° C. In the fixation experiment, one of the developers [1] to [20] was installed as the developer, and a solid image with a toner adhesion amount of 8 mg/cm$^2$ was fixed on an A4 high-quality paper sheet in a room temperature-room humidity environment (temperature: 20° C., humidity: 55% RH). The fixation experiment was repeated at different fixation temperature settings in such a manner that the fixation temperature was increased from 120° C. to 200° C. in steps of 5° C., in the results of the fixation experiment in which no image contamination due to cold offset was visually observed, the lowest one of the fixation temperatures was evaluated as the lowest fixable temperature. A developer having a lowest fixing temperature of 140° C. or lower was judged as pass.

(2) Heat Resistant Storage Stability 0.5 g of one of the toners [1] to [20] was placed in a 10 mL glass bottle having an inner diameter of 21 ram, and the glass bottle was covered with a lid. The bottle was shaken using a shaker "Tap Denser KYT-2000" (manufactured by Seishin Enterprise Co., Ltd.) 600 times at room temperature. Then the toner was left to stand in an environment of a temperature of 55° C. and a humidity of 35% RH for 2 hours with the lid removed. Then the toner was placed with care on a 48 mesh sieve (aperture: 350 μm) such that the aggregates of the toner were not pulverized, and the sieve was placed on a "powder tester" (manufactured by Hosokawa Micron Group) and secured using a pressing bar and a knob nut. The strength of vibrations was adjusted such that a feed width was 1 mm, and vibrations were applied for 10 seconds. Then the ratio (% by mass) of the amount of the toner remaining on the sieve was measured, and the aggregation ratio of the toner was computed using the following formula (A). The heat-resistant storage stability was evaluated on the basis of the obtained aggregation ratio of the toner. A toner having an aggregation ratio of 20% or less was judged as pass.

aggregation ratio (%) of toner=(mass (g) of toner remaining on sieve)/0.5 (g)×100 Formula (A):

TABLE 5

| | | EVALUATION RESULTS | |
|---|---|---|---|
| | TONER NO. | LOW-TEMPERATURE FIXABILITY LOWEST FIXABLE TEMPERATURE (° C.) | HEAT RESISTANT STORAGE STABILITY AGGREGATION RATIO (%) |
| EXAMPLE 1 | 1 | 115 | 14 |
| EXAMPLE 2 | 2 | 110 | 18 |
| EXAMPLE 3 | 3 | 130 | 12 |
| EXAMPLE 4 | 4 | 115 | 17 |
| EXAMPLE 5 | 5 | 125 | 15 |
| EXAMPLE 6 | 6 | 105 | 19 |
| EXAMPLE 7 | 7 | 135 | 12 |
| EXAMPLE 8 | 8 | 135 | 15 |
| EXAMPLE 9 | 9 | 120 | 19 |
| EXAMPLE 10 | 10 | 110 | 18 |
| EXAMPLE 11 | 11 | 120 | 13 |
| EXAMPLE 12 | 12 | 125 | 13 |
| EXAMPLE 13 | 13 | 110 | 19 |
| COMPARATIVE EXAMPLE 1 | 14 | 110 | 21 |
| EXAMPLE 14 | 15 | 140 | 16 |
| EXAMPLE 15 | 16 | 135 | 19 |
| COMPARATIVE EXAMPLE 2 | 17 | 150 | 16 |
| COMPARATIVE EXAMPLE 3 | 18 | 115 | 22 |
| EXAMPLE 16 | 19 | 140 | 15 |
| EXAMPLE 17 | 20 | 120 | 12 |

Reference Signs List

10 Toner particle
11 Matrix phase
12 Domain phase
12*a* Fine core particle
12*b* Coating layer
13 Second domain phase
20 Core particle
30 Shell layer
C Toner component (colorant)

The invention claimed is:

1. A toner for electrostatic image development, comprising toner particles containing an amorphous resin including an amorphous resin A and an amorphous resin B, and a crystalline polyester resin, wherein the toner particles have a domain-matrix structure in which a domain phase including fine core particles of the crystalline polyester resin is dispersed in a matrix phase including the amorphous resin A composed of a vinyl-based polymer, surface of the fine core particles being coated with the amorphous resin B composed of a vinyl-based polymer.

2. The toner for electrostatic image development according to claim 1, wherein the toner particles are configured such that a domain phase including a parting agent is further dispersed in the matrix phase.

3. The toner for electrostatic image development according to claim 1, wherein the following relations (1) and (2) hold:

$0.2 \leq A1 \leq 1.0$ and relation (1):

$0.2 \leq A1 - B1 \leq 0.8$ relation (2):

wherein A1 is a carboxy group concentration [mmol/g] in the amorphous resin A, and B1 is a carboxy group concentration [mmol/g] in the amorphous resin B, and an ester group concentration in the crystalline polyester resin is 7.0 to 12.0 mmol/g.

4. The toner for electrostatic image development according to claim 3, wherein the carboxy group concentration B1 in the amorphous resin B is 0 to 0.35 mmol/g.

5. The toner for electrostatic image development according to claim 1, wherein the crystalline polyester resin has a melting point of 40 to 95° C.

6. The toner for electrostatic image development according to claim 1, wherein the amorphous resin B has a weight average molecular weight of 100,000 to 250,000.

7. The toner for electrostatic image development according to claim 1, wherein a content of the crystalline polyester resin in the toner particles is 5 to 30% by mass.

8. The toner for electrostatic image development according to claim 1, wherein a mass ratio of the crystalline polyester resin to the amorphous resin B, being (the crystalline polyester resin/the amorphous resin B) is 10/90 to 80/20.

9. The toner for electrostatic image development according to claim 1, wherein the toner particles are obtained by aggregating and fusion-bonding fine particles of the amorphous resin A and fine composite particles that are obtained by subjecting the vinyl-based monomer forming the amorphous resin B to seed polymerization using the fine core particles of the crystalline polyester resin as seeds, with the surface of the fine core particles being coated with the amorphous resin B.

10. The toner for electrostatic image development according to claim 1, wherein the toner particles have a core-shell structure including a core particle and a shell layer coating a surface of the core particle; and the core particle has the domain-matrix structure.

* * * * *